US010074920B2

(12) United States Patent
Tran et al.

(10) Patent No.: US 10,074,920 B2
(45) **Date of Patent: *Sep. 11, 2018**

(54) INTERCONNECT CABLE WITH EDGE FINGER CONNECTOR

(71) Applicant: INTEL CORPORATION, Santa Clara, CA (US)

(72) Inventors: Donald T. Tran, Phoenix, AZ (US); Rajasekaran Swaminathan, Tempe, AZ (US)

(73) Assignee: INTEL CORPORATION, Santa Clara, CA (US)

( * ) Notice: Subject to any disclaimer, the term of this patent is extended or adjusted under 35 U.S.C. 154(b) by 157 days.

This patent is subject to a terminal disclaimer.

(21) Appl. No.: 14/822,693

(22) Filed: Aug. 10, 2015

(65) Prior Publication Data

US 2015/0357736 A1 Dec. 10, 2015

Related U.S. Application Data

(63) Continuation of application No. 13/870,938, filed on Apr. 25, 2013, now Pat. No. 9,118,151.

(51) Int. Cl.

| | |
|---|---|
| ***H01R 12/00*** | (2006.01) |
| ***H01R 12/72*** | (2011.01) |
| ***H01R 43/20*** | (2006.01) |
| ***H01R 13/6581*** | (2011.01) |
| ***H01R 12/71*** | (2011.01) |

(Continued)

(52) U.S. Cl.

CPC ..... *H01R 12/721* (2013.01); *H01R 12/714* (2013.01); *H01R 12/81* (2013.01); *H01R 13/6581* (2013.01); *H01R 13/6592* (2013.01); *H01R 43/205* (2013.01); *Y10T 29/49174* (2015.01); *Y10T 29/49176* (2015.01)

(58) Field of Classification Search

CPC ..... H01R 13/6658; H01R 23/688
USPC ..... 439/76.1, 108, 60, 637, 636, 405
See application file for complete search history.

(56) References Cited

U.S. PATENT DOCUMENTS 5,021,166 A * 6/1991 Torpey ..... B01D 33/042 100/152
6,416,335 B1 7/2002 Horchler
(Continued)

OTHER PUBLICATIONS

Notice of Allowance dated Apr. 24, 2015, issued in corresponding U.S. Appl. No. 13/870,938, filed Apr. 25, 2013, 11 pages.

*Primary Examiner* — Phuong Chi T Nguyen
(74) *Attorney, Agent, or Firm* — Schwabe, Williamson & Wyatt, P.C.

(57) ABSTRACT

Embodiments of the present disclosure are directed to an interconnect cable including a edge finger connector, and associated configurations and methods. The edge finger connector may be disposed at a first end of the interconnect cable and may connect the interconnect cable to an edge finger included in or coupled to a package substrate. The package substrate may be included in a processor package assembly, and a processor may be mounted on the substrate. The interconnect cable may include one or more elongate conductors, with contacts directly coupled to respective conductors. A second connector may be disposed at a second end of the interconnect cable, and may couple the interconnect cable to a small form-factor pluggable (SFP) case that is configured to connect the interconnect cable to an SFP cable. Other embodiments may be described and claimed.

21 Claims, 7 Drawing Sheets

(51) Int. Cl.
*H01R 12/81* (2011.01)
*H01R 13/6592* (2011.01)

(56) References Cited

U.S. PATENT DOCUMENTS

| | | | | |
|---|---|---|---|---|
| 6,607,308 | B2 | 8/2003 | Dair et al. | |
| 7,090,509 | B1 | 8/2006 | Gilliland et al. | |
| 8,840,432 | B2 * | 9/2014 | Alden, III | H01R 13/648 439/607.35 |
| 9,118,151 | B2 * | 8/2015 | Tran | H01R 12/721 |
| 9,147,977 | B2 * | 9/2015 | Poulsen | H01R 13/6463 |
| 2003/0119343 | A1 | 6/2003 | Lin et al. | |
| 2003/0152331 | A1 | 8/2003 | Dair et al. | |
| 2014/0270657 | A1 | 9/2014 | McColloch | |

* cited by examiner

INTERCONNECT CABLE WITH EDGE FINGER CONNECTOR

RELATED APPLICATIONS

This application is a continuation of U.S. patent application Ser. No. 13/870,938, entitled "INTERCONNECT CABLE WITH EDGE FINGER CONNECTOR," filed on Apr. 25, 2013, which is hereby incorporated by reference in its entirety for all purposes.

FIELD

Embodiments of the present disclosure generally relate to the field of computing systems, and more particularly, to interconnect cables with an edge finger connector.

BACKGROUND

Computing servers typically contain multiple server modules (e.g., in a "stack") coupled to a common switch rack. The individual server modules are coupled to the switch rack by external cables that connect to a port on the housing of the server module. The individual server modules include a processor disposed in the housing. The processor is coupled to a separate network interface card, and the network interface card is coupled to the port. The signal connection between the processor and port is also typically routed through the printed circuit board (motherboard) on which the processor assembly is mounted. The signal connection introduces significant insertion loss.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example and not by way of limitation in the figures of the accompanying drawings.

DETAILED DESCRIPTION

Figure 1A:
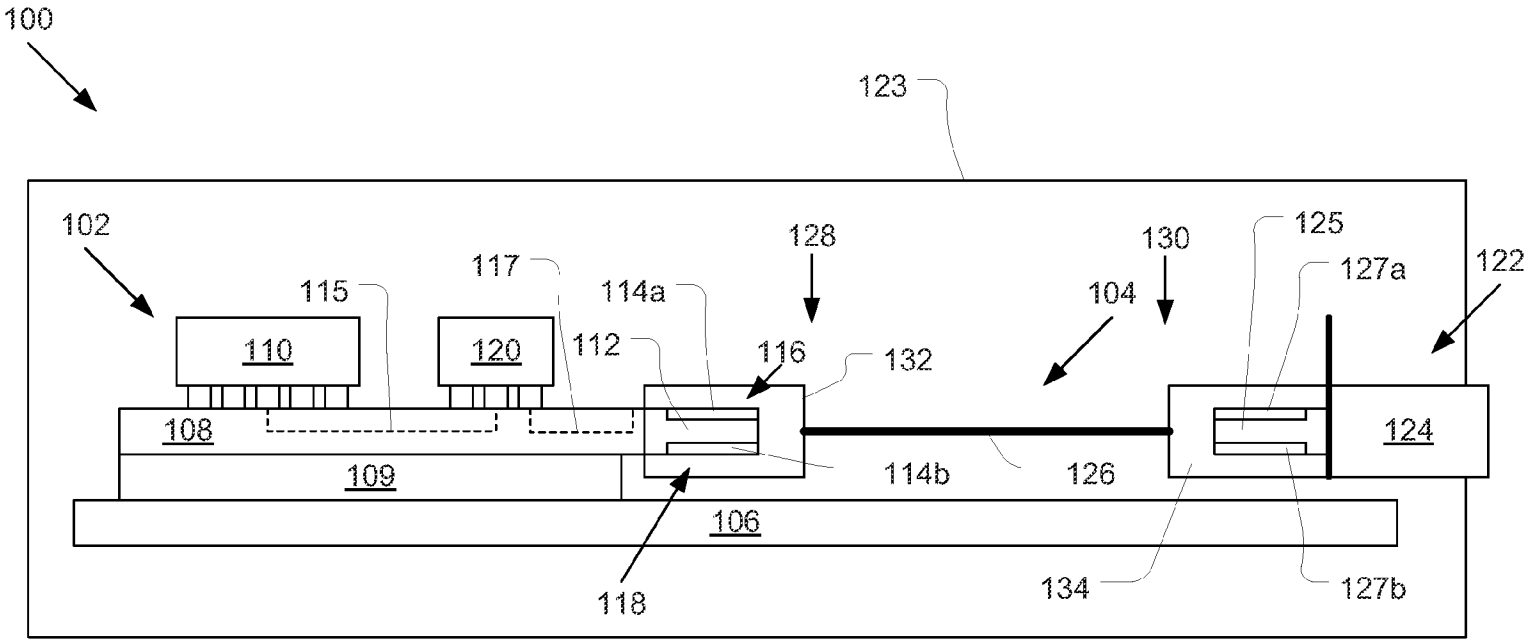
FIG. 1A schematically illustrates a computing system including a processor assembly with an edge finger, a small form-factor pluggable (SFP) case, and an interconnect cable, in accordance with some embodiments.

Embodiments of the present disclosure describe interconnect cables with edge finger connectors, and associated techniques and configurations. In the following description, various aspects of the illustrative implementations will be described using terms commonly employed by those skilled in the art to convey the substance of their work to others skilled in the art. However, it will be apparent to those skilled in the art that embodiments of the present disclosure may be practiced with only some of the described aspects. For purposes of explanation, specific numbers, materials and configurations are set forth in order to provide a thorough understanding of the illustrative implementations. However, it will be apparent to one skilled in the art that embodiments of the present disclosure may be practiced without the specific details. In other instances, well-known features are omitted or simplified in order not to obscure the illustrative implementations.

In the following detailed description, reference is made to the accompanying drawings which form a part hereof, wherein like numerals designate like parts throughout, and in which is shown by way of illustration embodiments in which the subject matter of the present disclosure may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The description may use perspective-based descriptions such as top/bottom, in/out, over/under, and the like. Such descriptions are merely used to facilitate the discussion and are not intended to restrict the application of embodiments described herein to any particular orientation.

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

The term "coupled with," along with its derivatives, may be used herein. "Coupled" may mean one or more of the following. "Coupled" may mean that two or more elements are in direct physical or electrical contact. However, "coupled" may also mean that two or more elements indirectly contact each other, but yet still cooperate or interact with each other, and may mean that one or more other elements are coupled or connected between the elements that are said to be coupled with each other. The term "directly coupled" may mean that two or more elements are in direct contact.

In various embodiments, the phrase "a first feature formed, deposited, or otherwise disposed on a second feature," may mean that the first feature is formed, deposited, or disposed over the second feature, and at least a part of the first feature may be in direct contact (e.g., direct physical and/or electrical contact) or indirect contact (e.g., having one or more other features between the first feature and the second feature) with at least a part of the second feature.

FIG. 1A illustrates a computing system 100 (hereinafter "system 100") in accordance with various embodiments. System 100 may include a processor package assembly 102 (hereinafter "package assembly 102") and an interconnect cable 104. The package assembly 102 may include a processor 110 disposed on a substrate 108. The package assembly may be mounted on a printed circuit board (PCB) 106.

In some embodiments, the package assembly 102 may include one or more intervening layers between the substrate 108 and the PCB 106, such as a socket layer 109. The processor 110 may be a central processing unit (CPU) die configured to process data. In some embodiments, the system 100 may be a server. In some embodiments, the system 100 may be included in a computing network (e.g., a server network) that includes a plurality of systems 100 (e.g., in a "stack") coupled to a common switch. In other embodiments, the system 100 may be included in another type of computing system.

Figure 2:
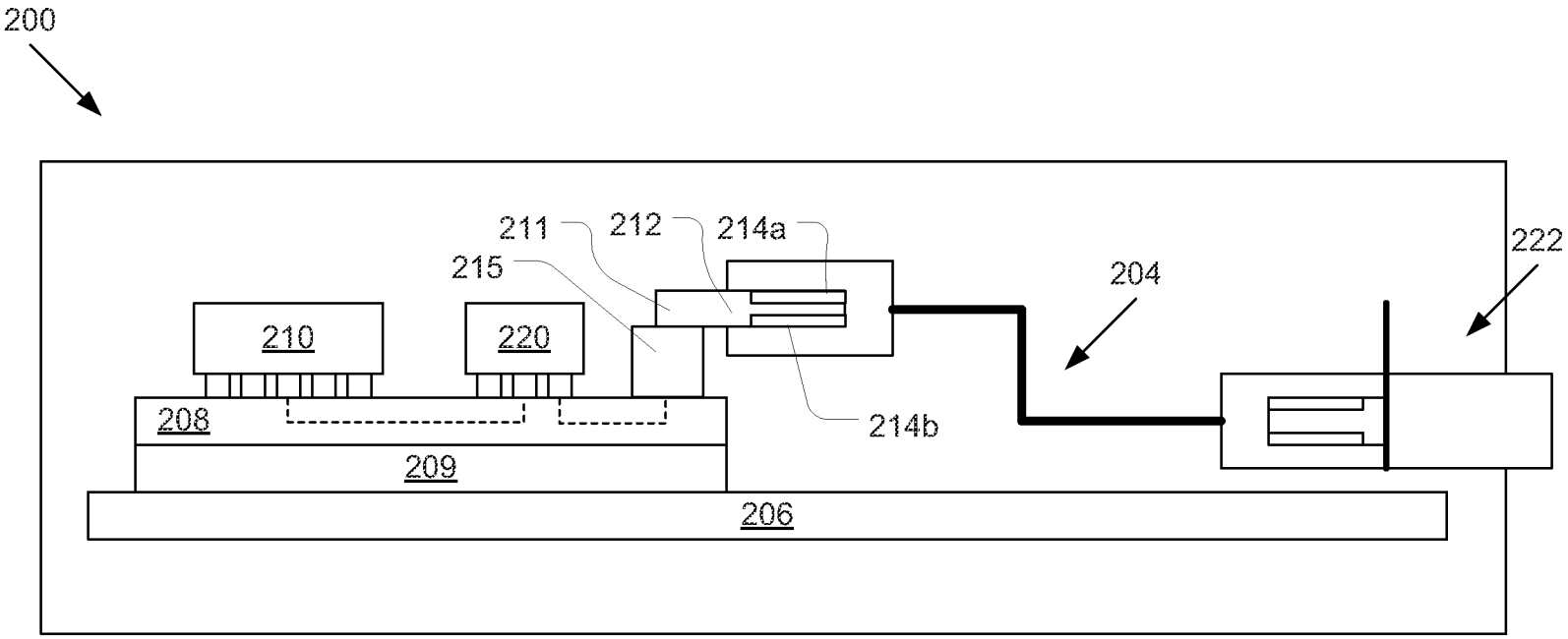
FIG. 2 schematically illustrates another computing system including a processor assembly with an edge finger on a flex substrate, in accordance with some embodiments.

In various embodiments, the system 100 may further include an edge finger 112. The edge finger 112 may be included in the substrate 108, as shown in FIG. 1A, or coupled to the substrate 108, as shown in FIG. 2, which is further discussed below. As shown in FIG. 1A, the edge finger 112 may overhang the socket layer 109.

The edge finger 112 may include a plurality of pads 114*a-b*. The pads 114*a-b* may be disposed on a top side 116 and/or a bottom side 118 of the edge finger 112. For example, FIG. 1 shows a top pad 114*a* on the top side 116 of the edge finger 112 and a bottom pad 114*b* on the bottom side 118 of the edge finger 112. The edge finger 112 may include a plurality of top pads 114*a* and/or bottom pads 114*b* on respective sides of the edge finger 112. For example, the plurality of top pads 114*a* and/or bottom pads 114*b* may be disposed in a row along the edge of the edge finger 112.

Figure 1B:
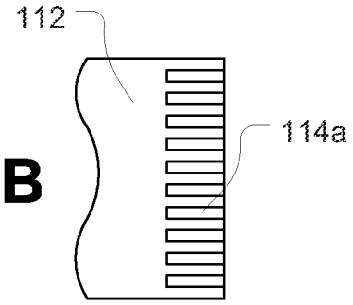
FIG. 1B schematically illustrates a top view of the edge finger of FIG. 1A, in accordance with some embodiments.

FIG. 1B illustrates a top view of the edge finger 112 with a plurality of top pads 114*a* in accordance with some embodiments. FIG. 1B merely illustrates an example, and other embodiments may include any suitable quantity and/or arrangement of pads 114*a-b*.

Referring again to FIG. 1A, in various embodiments, the pads 114*a-b* may be coupled to the processor 110 to route electrical signals to or from the processor 110. The pads 114*a-b* may include input pads (e.g., to route signals to the processor 110), output pads (e.g., to route signals from the processor 110), and/or ground pads (e.g., to provide a ground potential). Additionally, or alternatively, the pads 114*a-b* may include bidirectional pads to route signals to and from the processor 110.

The electrical signals may be routed between the processor 110 and the edge finger 112 via the substrate 108. In some embodiments, the electrical signals may also be routed between the processor 110 and the edge finger 112 via a network interface module 120. The network interface module 120 may be included in the package assembly 102 with the processor 110. The electrical signals may be routed between the processor 110 and the network interface module 120 via one or more electrical paths 115 in the substrate 108, and may be routed between the network interface module 120 and the edge finger 112 via one or more electrical paths 117 in the substrate 108. The network interface module 120 may be a network interface card (NIC) and/or a host fabric interface (HFI) in some embodiments. The network interface module 120 may facilitate operation of the system 100 within a computing network (e.g., server network).

The electrical signals routed to or from the processor 110 may include any suitable electrical signals, such as data signals, power signals, programming signals, request/instruction signals, clock signals, etc. In some embodiments, the electrical signals and/or interconnect cable 104 may conform with one or more interconnect protocols, such as common systems interconnect (CSI), QuickPath interconnect (QPI), and/or a CPU-CPU interconnect.

The system 100 may further include a small form-factor pluggable (SFP) case 122. The SFP case 122 may include an edge finger 125 with respective pads 127*a-b*. The interconnect cable 104 may couple the pads 114*a-b* of the edge finger 112 to respective pads 127*a-b* in the SFP case 122. The SFP case 122 may further include an SFP socket 124 to receive an external SFP cable (not shown) and couple the interconnect cable 104 to the external SFP cable (e.g., via the pads 127*a-b* on edge finger 125). In some embodiments, the SFP cable may couple the system 100 to a switch rack (not shown) of a server network. In some embodiments, the SFP case 122 may be a quad SFP (QSFP) case configured to couple the interconnect cable 104 to a QSFP cable.

In various embodiments, the interconnect cable 104 may include an elongate body 126 with a first end 128 and a second end 130. The interconnect cable 104 may include a first connector 132 at the first end 128 to engage the interconnect cable with the edge finger 112 and a second connector 134 at the second end 130 to engage the interconnect cable with the SFP case 122. Accordingly, the interconnect cable 104 may be a top-side interconnect to directly connect the package assembly 102 to the SFP case 122. The interconnect cable 104 may route electrical signals directly between the package assembly 102 and the SFP case 122, and the electrical signals may not be routed through the PCB 102. This may facilitate low insertion loss of the electrical signals routed to or from the processor 110.

As discussed above, the processor package assembly 102 may include an integrated network interface module 120. In prior systems, the processor package assembly is typically connected to an external NIC by a peripheral component interconnect express (PCI-e) cable. The NIC is then connected to the switch rack of the associated server network.

The system 100 may further include a housing 123 that encloses the package assembly 102 and interconnect cable 104. The SFP case 122 may be coupled to the housing 123, giving external access to the SFP socket 124. In some embodiments, the SFP case 122 may be spaced from the PCB 106 (e.g., not directly mounted on the PCB 106). The spacing of the SFP case 122 from the PCB 106 may be enabled by the direct connection between the edge finger 112 and the SFP case 122 provided by the interconnect cable 104. The spacing of the SFP case 122 from the PCB 106 may save board space on the PCB 106, may allow other components to be mounted on the PCB 106 below the SFP case 122, and/or may allow flexibility in placement of the SFP case 122 with respect to the housing 123.

As briefly discussed above, FIG. 2 illustrates an alternative computing system 200 with an edge finger 212 coupled to a substrate 208. The edge finger 212 may be included in a flex substrate 211 that is coupled to the substrate 208 by a connector 215. In some embodiments, the connector 215 may be a low insertion force (LIF) connector.

The system 200 may further include a processor 210 and a network interface module 220 coupled to the substrate 208. The substrate 208 may be coupled to a PCB 206 (e.g., via one or more intervening layers 209). The interconnect cable 104 may be used to couple the edge finger 212 to an SFP case 222.

Figure 3:
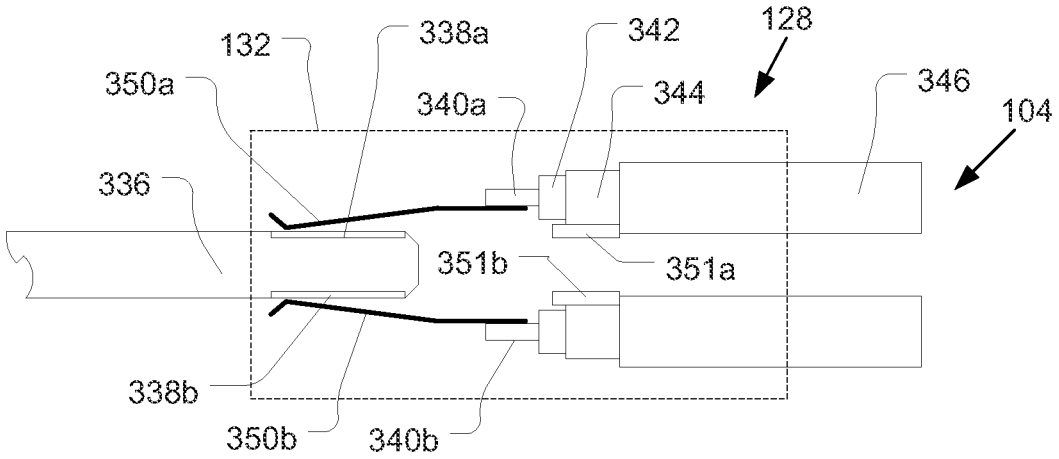
FIG. 3 illustrates a side view of a first end of an interconnect cable in accordance with some embodiments.

FIG. 3 illustrates a portion of the interconnect cable 104, showing the first end 128 and first connector 132 in greater detail, in accordance with some embodiments. The first connector 132 is shown engaged with an edge finger 336 having a plurality of pads 338*a-b*. The edge finger 336 may be similar to the edge finger 112 and/or 212, and may be included in or coupled to a substrate of a processor package assembly.

The body 126 of the interconnect cable 104 may include a plurality of elongate conductors 340*a-b*. The individual conductors 340*a-b* may run from the first end 128 to the second end 130 of the interconnect cable 104. The conductor 340*a-b* may be surrounded by an insulating layer 342. The insulating layer 342 may be surrounded by a ground shield 344 (e.g., a braided and/or wire ground shield). The ground shield may be surrounded by a protective sheath 346.

The plurality of conductors 340*a-b* may include a top conductor 340*a* and a bottom conductor 340*b*, as shown in FIG. 3, to connect to respective top and bottom pads 338*a-b* of the edge finger. In some embodiments, the top and bottom conductors 340*a-b* may be coupled together via a non-conductive coupling (e.g., a connecting between the respective protective sheaths 346). Additionally, or alternatively, the interconnect cable 104 may include a plurality of top conductors 340*a* and/or bottom conductors 340*b*. The plurality of top conductors 340*a* and/or bottom conductors 340*b* may be arranged in a strip and coupled to one another (e.g., in a ribbon cable configuration).

In some embodiments, the plurality of top conductors 340*a* and/or bottom conductors 340*b* may be arranged in axial pairs. For example, a pair of top conductors 340*a* and/or bottom conductors 340*b* may be coupled to one another and surrounded by the same insulating layer 342, ground shield 344, and/or protective sheath 346. In some embodiments, the axial pair of conductors may be wrapped around one another in a helix formation. In some embodiments, the axial pair of conductors may carry electrical signals in opposite directions (e.g., to the processor or from the processor).

In various embodiments, the first connector 132 may include a plurality of contacts 350*a-b*. The contacts 350*a-b* may be directly coupled to respective conductors 340*a-b* (e.g., not via a paddle card or other intermediary connection). The contacts 350*a-b* may be permanently coupled to the respective conductors 340*a-b*, for example, by soldering. The contacts 350*a-b* may also contact respective pads 338*a-b* on the edge finger 336 to provide the electrical connection between the interconnect cable 104 and the edge finger 336. The contacts 350*a-b* may be releasably coupled to respective pads 338*a-c*. For example, in some embodiments, the contacts 350*a-b* may be spring contacts. The spring contacts may be formed of a relatively flexible conductive material that may deflect when it comes in contact with the edge finger 336 to facilitate the coupling of the first connector 132 to the edge finger 336.

In various embodiments, the direct connection of the contacts 350*a-b* to the conductors 340*a-b* may provide lower insertion loss compared with interconnect cables that employ a paddle card between the elongate conductors and the contacts.

The interconnect cable 104 may further include one or more ground bars 351. The ground bar 351*a-b* may be coupled to one or more ground shields 344 of the interconnect cable 104. For example, the interconnect cable 104 may include a top ground bar 351*a* coupled to the ground shields 344 that are disposed around the top conductors 340*a* of the interconnect cable 104 and a bottom ground bar 351*b* coupled to the ground shields 344 that are disposed around the bottom conductors 340*b* of the interconnect cable 104.

Figure 5:
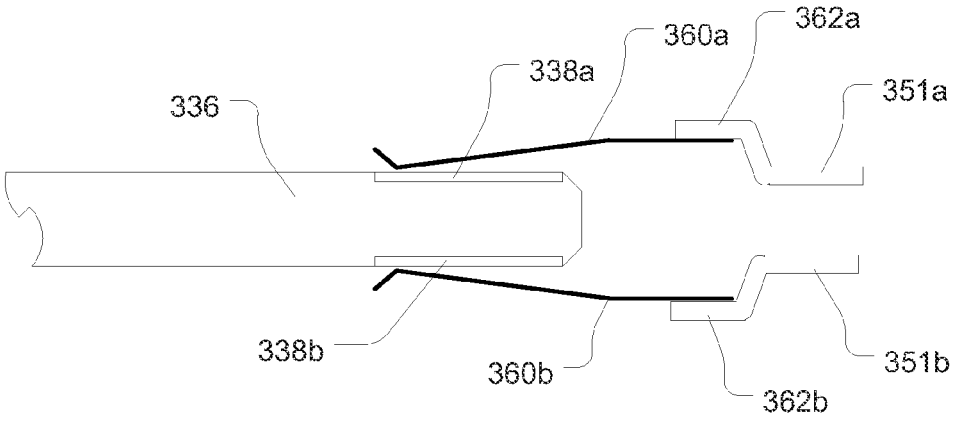
FIG. 5 illustrates a side view of ground contacts of an interconnect cable in accordance with some embodiments.

As shown in FIG. 5, the interconnect cable 104 may further include one or more ground contacts 560*a-b* coupled to the ground bar 351*a-b*. The ground contacts 560*a-b* may be adjacent to and/or interposed with the contacts 350*a-b* coupled to the conductors 340*a-b*. In some embodiments, the ground bar 351*a-b* may include one or more finger extensions 562*a-b*, and the ground contacts 560*a-b* may be coupled to the finger extensions 562*a-b*. The ground contacts 560*a-b* may contact respective pads 338*a-b* (e.g., ground pads) on the edge finger 336.

Figure 4:
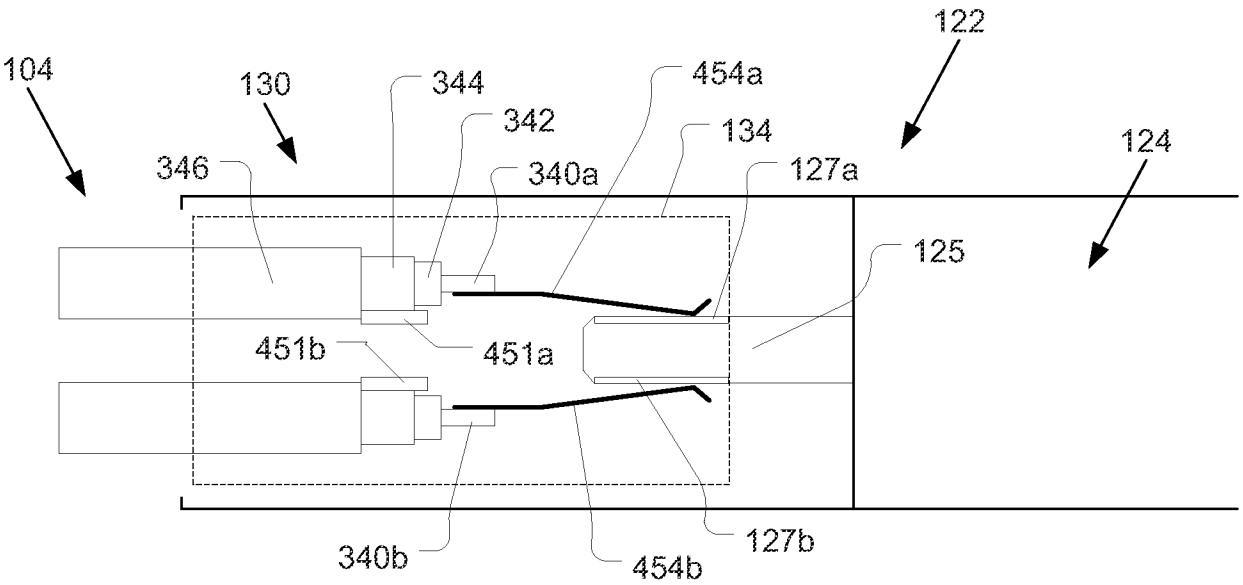
FIG. 4 illustrates a side view of a second end of the interconnect cable of FIG. 3, in accordance with some embodiments.

FIG. 4 illustrates another portion of the interconnect cable 104, showing the second end 130 and second connector 134 in greater detail in accordance with some embodiments. The second connector 134 is shown engaged with the edge finger 125 of the SFP case 122.

In some embodiments, as shown in FIG. 4, the second connector 134 may be of a same design as the first connector 132. That is, the second connector 134 may have a similar arrangement of components to the first connector 132. For example, the second connector 134 may include a plurality of contacts 454*a-b*, and the contacts 454*a-b* may be directly coupled to respective conductors 340*a-b* (e.g., not via a paddle card or other intermediary connection) at the second end 130 of the interconnect cable 104. The contacts 454*a-b* may also contact respective pads 127*a-b* on the edge finger 125 to provide the electrical connection between the conductors 340*a-b* and the SFP case 122. In some embodiments, the contacts 454*a-b* may be spring contacts, as shown in FIG. 4.

Although the second connector 134 may be of a same design as the first connector 132, the second connector 134 may differ from the first connector 132 in one or more size dimensions, and/or in the number of conductors and/or contacts included in the second connector 134 compared with the first connector 132.

In some embodiments, the interconnect cable 104 may further include ground bars 451*a-b* coupled to the ground shields 344 at the second end 130 of the interconnect cable 104. In some embodiments, the interconnect cable 104 may include one or more ground contacts (similar to ground contacts 560*a-b*) to couple the ground bars 451*a-b* to one or more ground pads on the edge finger 125.

In some embodiments, the conductors 340*a-b* of the interconnect cable 104 may be split into two or more cable portions terminated into separate second connectors 134. The plurality of second connectors 134 may connect to different SFP cases 122 of the system 100.

In some embodiments, one or more of the pads 127*a-b* on the edge finger 125 of the SFP case 122 may be used to route one or more electrical signals to the PCB 106. For example, the electrical signals routed to the PCB 106 may include one or more side-band signals, such as clock signals and/or power signals. The electrical connection between the SFP case 122 and the PCB 106 may be provided by the interconnect cable 104 and/or another interconnect cable.

Figure 6:
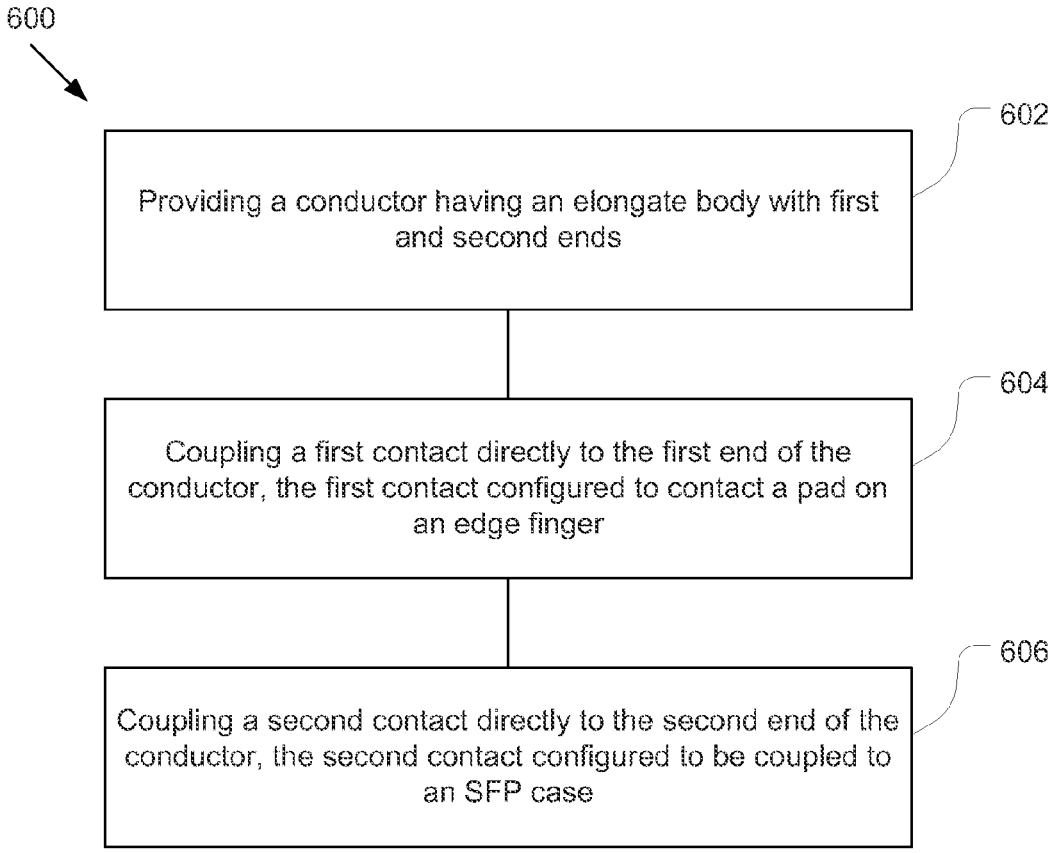
FIG. 6 illustrates a flow chart of a method of manufacturing a computing system in accordance with some embodiments.

FIG. 6 illustrates a method for manufacturing an interconnect cable (e.g., interconnect cable 104) and/or computing system (e.g., system 100 or system 200) in accordance with some embodiments. The method 600 may comport with embodiments described in connection with FIGS. 1-5.

At 602, method 600 may include providing a conductor (e.g., conductor 340*a-b*) having an elongate body to carry an electrical signal between first and second ends of the conductor. In some embodiments, the method 600 may further include surrounding the conductor by an insulating layer (e.g., insulating layer 342), ground shield (e.g., ground shield 344), and/or protective sheath (e.g., protective sheath 346).

At 604, the method 600 may further include coupling a first contact (e.g., contact 350*a-b*) directly to the first end of the conductor. The first contact may be configured to contact a pad on an edge finger (e.g., edge finger 112, 212, and/or 336). The edge finger may be included in or coupled to a substrate to route electrical signals to or from a processor coupled to the substrate, as described herein.

At 606, the method 600 may further include coupling a second contact directly to the second end of the conductor. The second contact may be configured to be coupled to an SFP case (e.g., SFP case 122), and the SFP case may be configured to couple the second contact to an SFP cable (e.g., a QSFP cable). In some embodiments, the second contact may contact a pad of an edge finger included in the SFP case.

Some embodiments of the method 600 may further include coupling the first contact with the edge finger included in or coupled to the substrate. Additionally, or alternatively, some embodiments may include coupling the second contact with the SFP case.

Various operations are described as multiple discrete operations in turn, in a manner that is most helpful in understanding the claimed subject matter. However, the order of description should not be construed as to imply that these operations are necessarily order dependent. Embodiments of the present disclosure may be implemented into a system using any suitable hardware and/or software to configure as desired.

Figure 7:
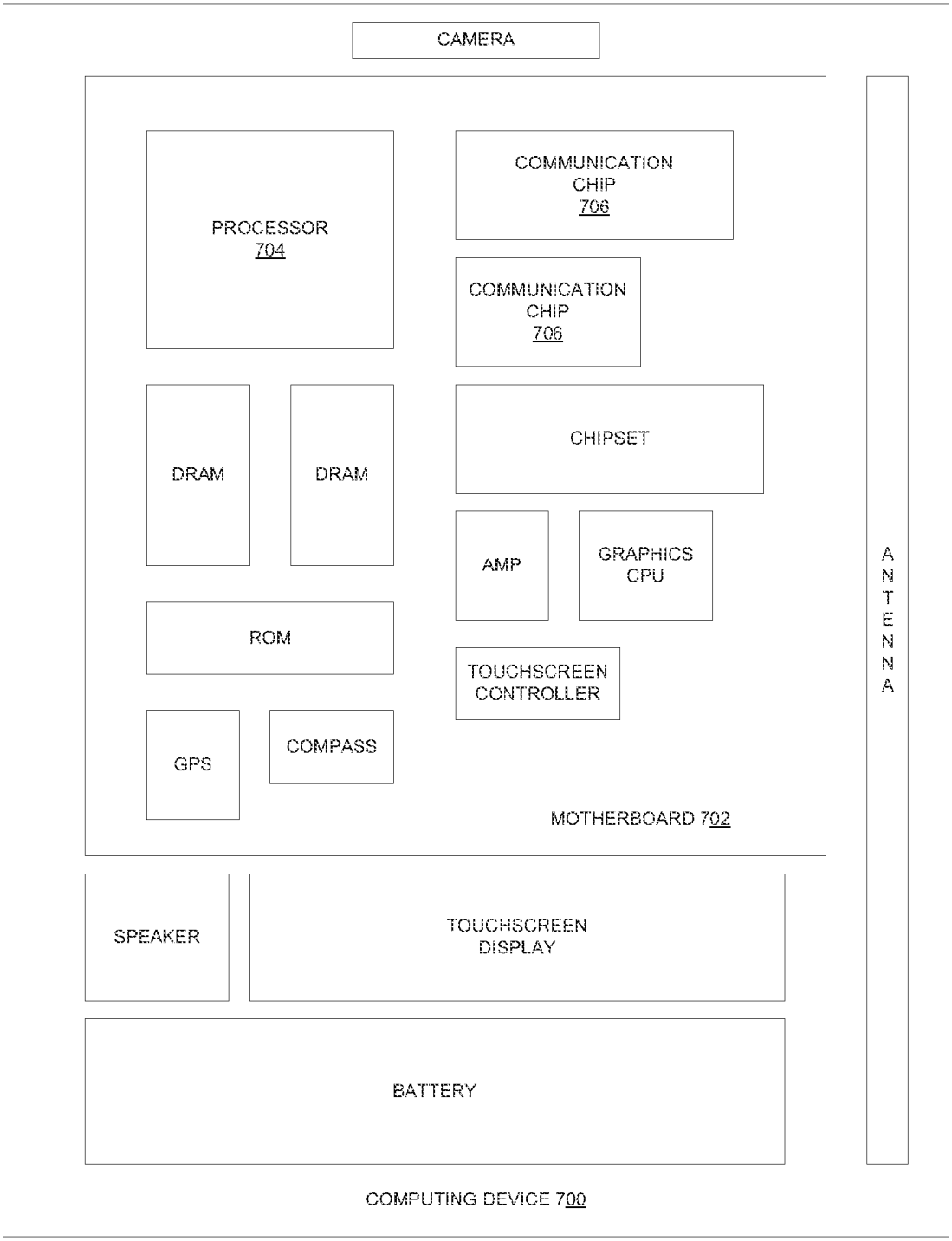
FIG. 7 schematically illustrates a computing device in accordance with some embodiments.

FIG. 7 schematically illustrates a computing device 700 in accordance with some embodiments. The computing device 700 may house a board such as motherboard 702. The motherboard 702 may be, for example, the PCB 106 or 206 described herein. The motherboard 702 may include a number of components, including but not limited to a processor 704 and at least one communication chip 706. The processor 704 may be physically and electrically coupled to the motherboard 702. In some implementations, the at least one communication chip 606 may also be physically and electrically coupled to the motherboard 702. In further implementations, the communication chip 706 may be part of the processor 704.

According to various embodiments, the processor 704 may include one or more components of the processor package assembly 102 or 202 described herein.

Depending on its applications, computing device 700 may include other components that may or may not be physically and electrically coupled to the motherboard 702. These other components may include, but are not limited to, volatile memory (e.g., DRAM), non-volatile memory (e.g., ROM), flash memory, a graphics processor, a digital signal processor, a crypto processor, a chipset, an antenna, a display, a touchscreen display, a touchscreen controller, a battery, an audio codec, a video codec, a power amplifier, a global positioning system (GPS) device, a compass, a Geiger counter, an accelerometer, a gyroscope, a speaker, a camera, and a mass storage device (such as hard disk drive, compact disk (CD), digital versatile disk (DVD), and so forth).

The communication chip 706 may enable wireless communications for the transfer of data to and from the computing device 700. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication chip 706 may implement any of a number of wireless standards or protocols, including but not limited to Institute for Electrical and Electronic Engineers (IEEE) standards including Wi-Fi (IEEE 802.11 family), WiGig, IEEE 802.16 standards (e.g., IEEE 802.16-2005 Amendment), Long-Term Evolution (LTE) project along with any amendments, updates, and/or revisions (e.g., advanced LTE project, ultra mobile broadband (UMB) project (also referred to as "3GPP2"), etc.). IEEE 802.16 compatible BWA networks are generally referred to as WiMAX networks, an acronym that stands for Worldwide Interoperability for Microwave Access, which is a certification mark for products that pass conformity and interoperability tests for the IEEE 802.16 standards. The communication chip 606 may operate in accordance with a Global System for Mobile Communication (GSM), General Packet Radio Service (GPRS), Universal Mobile Telecommunications System (UMTS), High Speed Packet Access (HSPA), Evolved HSPA (E-HSPA), or LTE network. The communication chip 606 may operate in accordance with Enhanced Data for GSM Evolution (EDGE), GSM EDGE Radio Access Network (GERAN), Universal Terrestrial Radio Access Network (UTRAN), or Evolved UTRAN (E-UTRAN). The communication chip 706 may operate in accordance with Code Division Multiple Access (CDMA), Time Division Multiple Access (TDMA), Digital Enhanced Cordless Telecommunications (DECT), Evolution-Data Optimized (EV-DO), derivatives thereof, as well as any other wireless protocols that are designated as 3G, 4G, 5G, and beyond. In some embodiments, the communication chip 706 may communicate over a mm-wave network. The communication chip 706 may operate in accordance with other wireless protocols in other embodiments.

In some embodiments, the computing device 700 may include a plurality of communication chips 706. For instance, a first communication chip 706 may be dedicated to shorter range wireless communications such as millimeter-wave, Wi-Fi, and/or Bluetooth and a second communication chip 706 may be dedicated to longer range wireless communications such as GPS, EDGE, GPRS, CDMA, WiMAX, LTE, Ev-DO, and/or others.

In various implementations, the computing device 700 may be a server, a laptop, a netbook, a notebook, an ultrabook, a smartphone, a tablet, a personal digital assistant (PDA), an ultra mobile PC, a mobile phone, a desktop computer, a printer, a scanner, a monitor, a set-top box, an entertainment control unit, a digital camera, a portable music player, or a digital video recorder. In further implementations, the computing device 600 may be any other electronic device that processes data.

EXAMPLES

In one example, an apparatus for connecting a processor package assembly with another component is provided that includes: a conductor having an elongate body configured to carry electrical signals; and a contact directly coupled to the conductor, wherein the contact is configured to contact a pad on an edge finger; wherein the edge finger is included in or coupled to a substrate to route the electrical signals to or from a processor coupled to the substrate.

In some embodiments of the apparatus, the contact is a first contact directly coupled to a first end of the conductor, and the apparatus further includes a second contact directly coupled to a second end of the conductor, wherein the second contact is configured to be coupled to a small form-factor pluggable (SFP) case, wherein the SFP case is configured to couple the second contact to an SFP cable.

In some embodiments of the apparatus, the first and second contacts are of a same design.

In some embodiments of the apparatus, the substrate and the processor are coupled to a printed circuit board (PCB), and wherein the SFP case is spaced from the PCB.

In some embodiments of the apparatus, the contact is a spring contact.

In some embodiments of the apparatus, the conductor is a first conductor, the contact is a first contact, and the pad is a first pad on a first side of the edge finger, and the apparatus further includes: a second conductor having an elongate body configured to carry an electrical signal; and a second contact directly coupled to the second conductor, wherein the second contact is configured to contact a second pad on a second side of the edge finger.

In some embodiments of the apparatus, the apparatus further includes: a ground shield disposed around the conductor; a ground bar coupled to the ground shield; and a ground contact coupled to the ground bar and configured to couple the ground bar to a ground pad of the edge finger.

In some embodiments of the apparatus, the apparatus includes a plurality of elongate conductors directly coupled to respective contacts; the plurality of elongate conductors include the conductor; and the plurality of elongate conductors are arranged in axial pairs.

In some embodiments of the apparatus, the apparatus includes the edge finger.

In another example, a method for manufacturing an interconnect cable is provided that includes: providing a conductor having an elongate body configured to carry electrical signals; and coupling a contact directly to the conductor, wherein the contact is configured to contact a pad on an edge finger; wherein the edge finger is included in or coupled to a substrate to route electrical signals to or from a processor coupled to the substrate.

In some embodiments of the method, the contact is a first contact directly coupled to a first end of the conductor, and the method further includes: coupling a second contact directly to a second end of the conductor, wherein the second contact is configured to be coupled to a small form-factor pluggable (SFP) case, and wherein the SFP case is configured to couple the second contact to an SFP cable.

In some embodiments of the method, the contact is a spring contact.

In some embodiments of the method, the conductor is a first conductor, the contact is a first contact, and the pad is a first pad on a first side of the edge finger, and the method further includes: coupling a second conductor to the first conductor via a nonconductive coupling, the second conductor having an elongate body configured to carry an electrical signal; and coupling a second contact directly to the second conductor, wherein the second contact is configured to contact a second pad on a second side of the edge finger.

In some embodiments of the method, a ground shield is disposed around the conductor, and the method further includes: coupling a ground bar to the ground shield; and coupling a ground contact to the ground bar, the ground contact configured to couple the ground bar to a ground pad of the edge finger.

In another example, a system for interconnecting a package assembly with another component is provided that includes: a printed circuit board (PCB) and a package assembly coupled to the PCB. The package assembly includes: a substrate; a processor disposed on the substrate; and an edge finger included in or coupled to the substrate, the edge finger including a plurality of pads to route electrical signals to or from the processor. The system further includes an interconnect cable coupled to the package assembly via the edge finger, the interconnect cable including: a conductor having an elongate body configured to carry the electrical signals; and a contact directly coupled to the conductor, wherein the contact is configured to contact a first pad of the plurality of pads of the edge finger.

In some embodiments of the system, the contact is a first contact coupled to a first end of the conductor, the system further includes a small form-factor pluggable (SFP) case configured to couple the interconnect cable to an external SFP cable, and the interconnect cable further includes a second contact directly coupled to a second end of the conductor and to the SFP case.

In some embodiments of the system, the first and second contacts are of a same design.

In some embodiments, the system further includes a housing enclosing the package assembly, wherein the SFP case is mounted in the housing and spaced from the PCB.

In some embodiments of the system, the contact is a spring contact.

In some embodiments of the system, the conductor is a first conductor, the contact is a first contact configured to contact a first side of the edge finger, and the apparatus further includes: a second conductor having an elongate body configured to carry an electrical signal; and a second contact directly coupled to the second conductor, wherein the second contact is connected to a second side of the edge finger to route signals to or from the processor.

In some embodiments of the system, the system further includes: a ground shield disposed around the conductor; a ground bar coupled to the ground shield; and a ground contact coupled between the ground bar and a ground pad of the edge finger.

In some embodiments of the system, the edge finger is included in the substrate and overhangs an intervening layer between the substrate and the PCB.

In some embodiments of the system, the edge finger is included in a flex substrate that is coupled to the substrate by a low insertion force (LIF) connector.

In some embodiments of the system, the package assembly includes an integrated network interface module.

In some embodiments of the system, the electrical connection between the processor and the edge finger is routed through the substrate and not the PCB.

Various embodiments may include any suitable combination of the above-described embodiments. Furthermore, some embodiments may include one or more non-transitory computer-readable media having instructions, stored thereon, that when executed result in actions of any of the above-described embodiments. Moreover, some embodiments may include apparatuses or systems having any suitable means for carrying out the various operations of the above-described embodiments.

The above description of illustrated implementations, including what is described in the Abstract, is not intended to be exhaustive or to limit the embodiments of the present disclosure to the precise forms disclosed. While specific implementations and examples are described herein for illustrative purposes, various equivalent modifications are possible within the scope of the present disclosure, as those skilled in the relevant art will recognize.

These modifications may be made to embodiments of the present disclosure in light of the above detailed description. The terms used in the following claims should not be construed to limit various embodiments of the present disclosure to the specific implementations disclosed in the specification and the claims. Rather, the scope is to be determined entirely by the following claims, which are to be construed in accordance with established doctrines of claim interpretation.

What is claimed is:

1. An apparatus comprising:

a conductor having an elongate body to carry electrical signals; and a first contact directly coupled to a first end of the conductor, wherein the first contact is to contact a pad on an edge finger;

a second contact directly coupled to a second end of the conductor, wherein the second contact is to be coupled to a small form-factor pluggable (SFP) case, wherein the SFP case is to couple the second contact to an SFP cable, wherein the edge finger is included in or coupled to a substrate to route the electrical signals to or from a processor coupled to the substrate.

2. The apparatus of claim 1, wherein the first and second contacts are of a same design.

3. The apparatus of claim 1, wherein the substrate and the processor are coupled to a printed circuit board (PCB), and wherein the SFP case is spaced from the PCB.

4. The apparatus of claim 1, wherein the contact is a spring contact.

5. The apparatus of claim 1, wherein the conductor is a first conductor, the contact is a first contact, and the pad is a first pad on a first side of the edge finger, and wherein the apparatus further includes:

a second conductor having an elongate body, to carry an electrical signal; and a second contact directly coupled to the second conductor, wherein the second contact is to contact a second pad on a second side of the edge finger.

6. The apparatus of claim 1, further comprising:

a ground shield disposed around the conductor;

a ground bar coupled to the ground shield; and a ground contact coupled to the ground bar, to couple the ground bar to a ground pad of the edge finger.

7. The apparatus of claim 1, wherein:

the apparatus includes a plurality of elongate conductors directly coupled to respective contacts;

the plurality of elongate conductors include the conductor; and the plurality of elongate conductors are arranged in axial pairs.

8. A method comprising:

providing a conductor having an elongate body to carry electrical signals; and coupling a contact directly to the conductor, wherein the contact is to contact a pad on an edge finger;

coupling a ground bar to a ground shield disposed around the conductor; and coupling a ground contact to the ground bar, the ground contact to couple the ground bar to a ground pad of the edge finger, wherein the edge finger is included in or coupled to a substrate to route electrical signals to or from a processor coupled to the substrate.

9. The method of claim 8, wherein the contact is a first contact directly coupled to a first end of the conductor, the method further comprising:

coupling a second contact directly to a second end of the conductor, wherein the second contact is to be coupled to a small form-factor pluggable (SFP) case, and wherein the SFP case is to couple the second contact to an SFP cable.

10. The method of claim 8, wherein the contact is a spring contact.

11. The method of claim 8, wherein the conductor is a first conductor, the contact is a first contact, and the pad is a first pad on a first side of the edge finger, and wherein the method further includes:

coupling a second conductor to the first conductor via a nonconductive coupling, the second conductor having an elongate body to carry an electrical signal; and coupling a second contact directly to the second conductor, wherein the second contact is to contact a second pad on a second side of the edge finger.

12. A system comprising:

a printed circuit board (PCB);

a package assembly coupled to the PCB, the package assembly including:

a substrate;

a processor disposed on the substrate; and an edge finger included in or coupled to the substrate, the edge finger including a plurality of pads to route electrical signals to or from the processor; and an interconnect cable coupled to the package assembly via the edge finger, the interconnect cable including:

a conductor having an elongate body to carry the electrical signals; and a contact directly coupled to the conductor, wherein the contact is to contact a first pad of the plurality of pads of the edge finger, wherein the electrical signals between the processor and the edge finger are routed through the substrate and not the PCB.

13. The system of claim 12, wherein the contact is a spring contact.

14. The system of claim 12, wherein the conductor is a first conductor and the contact is a first contact, to contact a first side of the edge finger, and wherein the system further includes:

a second conductor having an elongate body, to carry an electrical signal; and a second contact directly coupled to the second conductor, wherein the second contact is connected to a second side of the edge finger to route signals to or from the processor.

15. The system of claim 12, further comprising:

a ground shield disposed around the conductor;

a ground bar coupled to the ground shield; and a ground contact coupled between the ground bar and a ground pad of the edge finger.

16. The system of claim 12, wherein the edge finger is included in the substrate and overhangs an intervening layer between the substrate and the PCB.

17. The system of claim 12, wherein the edge finger is included in a flex substrate that is coupled to the substrate by a low insertion force (LIF) connector.

18. The system of claim 12, wherein the package assembly includes an integrated network interface module.

19. The system of claim 12, wherein the contact is a first contact coupled to a first end of the conductor, wherein the system further comprises a small form-factor pluggable (SFP) case, to couple the interconnect cable to an external SFP cable; and wherein the interconnect cable further includes a second contact directly coupled to a second end of the conductor and to the SFP case.

20. The system of claim 19, wherein the first and second contacts are of a same design.

21. The system of claim 19, further comprising a housing enclosing the package assembly, wherein the SFP case is mounted in the housing and spaced from the PCB.

* * * * *